US007300316B1

(12) United States Patent
Chen et al.

(10) Patent No.: US 7,300,316 B1
(45) Date of Patent: Nov. 27, 2007

(54) ELECTRICAL CONNECTING ASSEMBLY

(75) Inventors: Tung-Yuan Chen, Taipei (TW); Chao-Yi Wu, Taipei (TW)

(73) Assignee: Cyber Power System Inc. (TW)

( * ) Notice: Subject to any disclaimer, the term of this patent is extended or adjusted under 35 U.S.C. 154(b) by 0 days.

(21) Appl. No.: 11/634,240

(22) Filed: Dec. 6, 2006

(51) Int. Cl.
*H01R 13/64* (2006.01)

(52) U.S. Cl. ..... 439/677

(58) Field of Classification Search ..... 439/680, 439/677, 762, 522, 754, 638, 607, 108; 429/1; 174/138 F
See application file for complete search history.

(56) References Cited

U.S. PATENT DOCUMENTS 3,980,388 A * 9/1976 Nailor, III ..... 439/752
4,226,497 A * 10/1980 Polonsky et al. ..... 439/677
4,572,878 A * 2/1986 Daugherty ..... 429/62
5,442,138 A * 8/1995 Ochi ..... 174/138 F
5,645,448 A * 7/1997 Hill ..... 439/522
6,428,363 B2 * 8/2002 Tamai et al. ..... 439/677
6,533,619 B2 * 3/2003 Wakata et al. ..... 439/680
6,576,838 B2 * 6/2003 Matsumura ..... 174/66
6,598,595 B2 * 7/2003 Yasui ..... 123/572
7,176,780 B2 * 2/2007 Iwata ..... 337/188

* cited by examiner

*Primary Examiner*—Tulsidas C. Patel
*Assistant Examiner*—Harshad C Patel
(74) *Attorney, Agent, or Firm*—Hershkovitz & Associates, LLC; Abe Hershkovitz

(57) ABSTRACT

An electrical connecting assembly has an electrical appliance and a connector. The electrical appliance has at least one surface, a positive electrode plug and a negative electrode plug. The plugs are mounted separately on the surface. The connector connects to the electrical appliance and has two electrical wires and an anti-error sheath. The electrical wires respectively have a positive electrode socket and a negative electrode socket. The positive and negative electrode sockets connect respectively to the positive and negative electrode plugs. The anti-error sheath connects to one of the sockets and has a socket sheath with mounting key protruding longitudinally from the socket sheath. The mounting key ensures that the socket on the wire on which the anti-error sheath is connected can only be plugged onto the correct plug.

4 Claims, 5 Drawing Sheets

ELECTRICAL CONNECTING ASSEMBLY

BACKGROUND OF THE INVENTION

1. Field of Invention

The present invention relates to an electrical connecting assembly, and more particularly to an electrical connecting assembly with two plugs and two sockets that keep the plugs from being plugged into the incorrect sockets.

2. Description of the Related Art

With reference to FIG. 5, a conventional electrical connecting assembly comprises a connector (40) and an electrical appliance (50). The connector (40) has two electrical wires. The electrical wires respectively have two sockets (41, 41'). One of the sockets (41, 41') is a positive electrode socket (41). The other is a negative electrode socket (41'). The electrical appliance (50) has two plugs (51, 51'). The plugs (51, 51 ') are mounted in and electrically connect to the corresponding sockets (41,41'). One of the plugs (51, 51') is a positive electrode plug (51) corresponding to the positive electrode socket (41). The other is a negative electrode plug (51') corresponding to the negative electrode socket (41'). Because the plugs (51, 51') are often plugged into the incorrect sockets (41, 41'), the socket (41, 41 ') and the electrical appliance (50) around the two plugs (51, 51') are dyed corresponding colors. The different colors are use to assist in ensuring that the sockets (41, 41') are plugged respectively onto the correct plugs (51, 51').

However, the sockets (41, 41') are stilled plugged onto the incorrect plugs (51, 51') when users are inattentive or the plugs are not visible to the user. Furthermore, if users are color blind or weak vision, they may not recognize different colors. Plugging the sockets (41, 41') onto the incorrect plugs (51, 51') easily occurs and is troublesome to the users.

To overcome the shortcomings, the present invention provides an electrical connecting assembly to obviate the aforementioned problem.

SUMMARY OF THE INVENTION

The primary objective of the present invention is to provide an electrical connecting assembly with two plugs and two corresponding sockets that prevent sockets from being plugged respectively onto the incorrect plugs.

To achieve the objective, the electrical connecting assembly in accordance with the present invention has an electrical appliance and a connector. The electrical appliance has at least one surface, a positive electrode plug and a negative electrode plug. The positive electrode plug mounted on the surface. The negative electrode plug mounted on a surface separate from the positive electrode plug. The connector connects to the electrical appliance and has two electrical wires and an anti-error sheath. The electrical wires respectively have a positive electrode socket and a negative electrode socket. The positive electrode socket connects to the positive electrode plug. The negative electrode socket connects to the negative electrode plug. The anti-error sheath connects to one of the sockets and has a socket sheath with mounting key protruding longitudinally from the socket sheath. The mounting key ensures that the socket on the wire on which the anti-error sheath is connected can only be plugged onto the correct plug. Color blindness and weak vision are no longer factors to plugging the sockets respectively onto the correct plugs.

Other objectives, advantages and novel features of the invention will become more apparent from the following detailed description when taken in conjunction with the accompanying drawings.

DETAILED DESCRIPTION OF THE INVENTION

Figure 1:
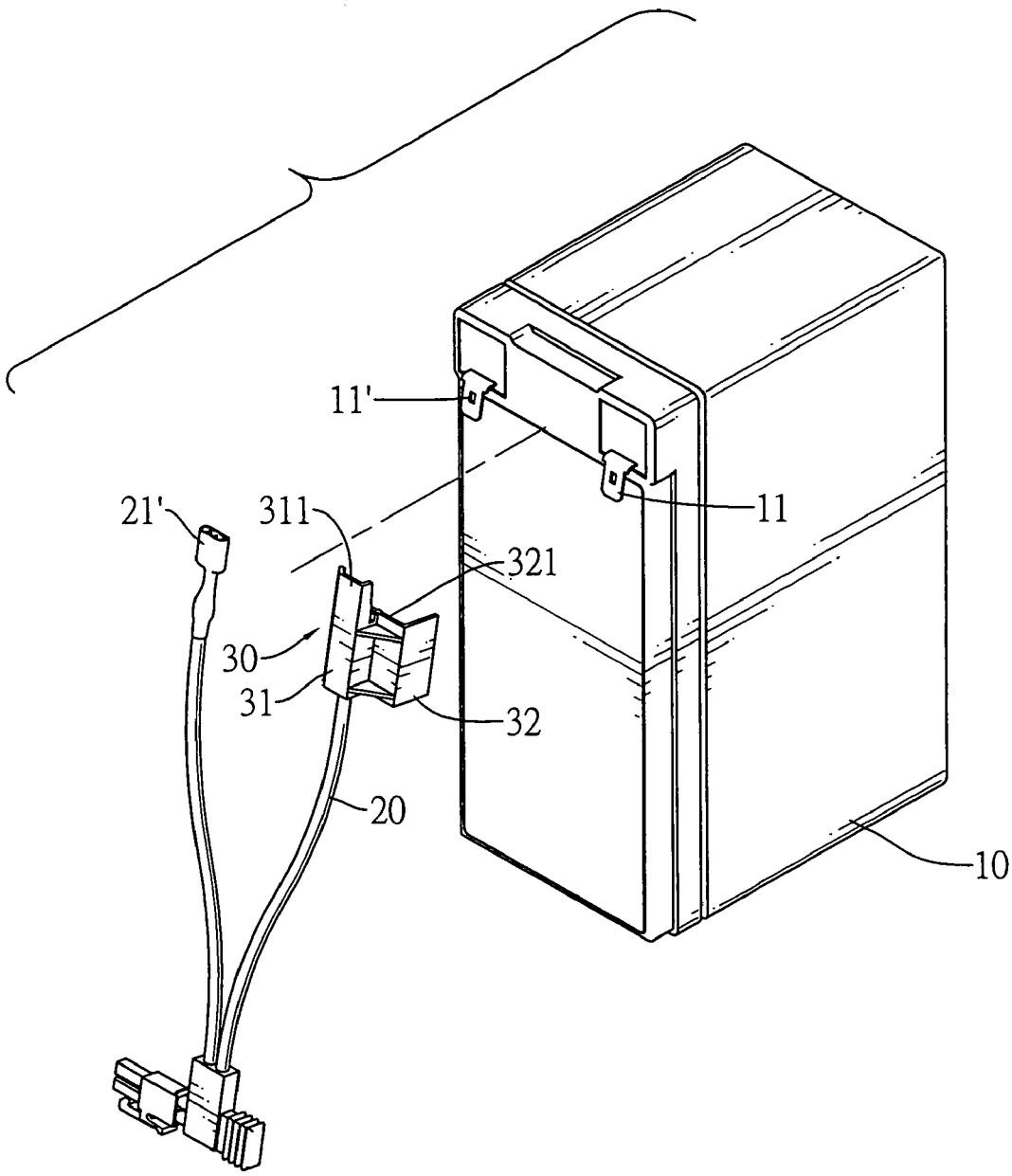
FIG. 1 is a partially exploded perspective view of an electrical connecting assembly in accordance with the present invention.
Figure 2:
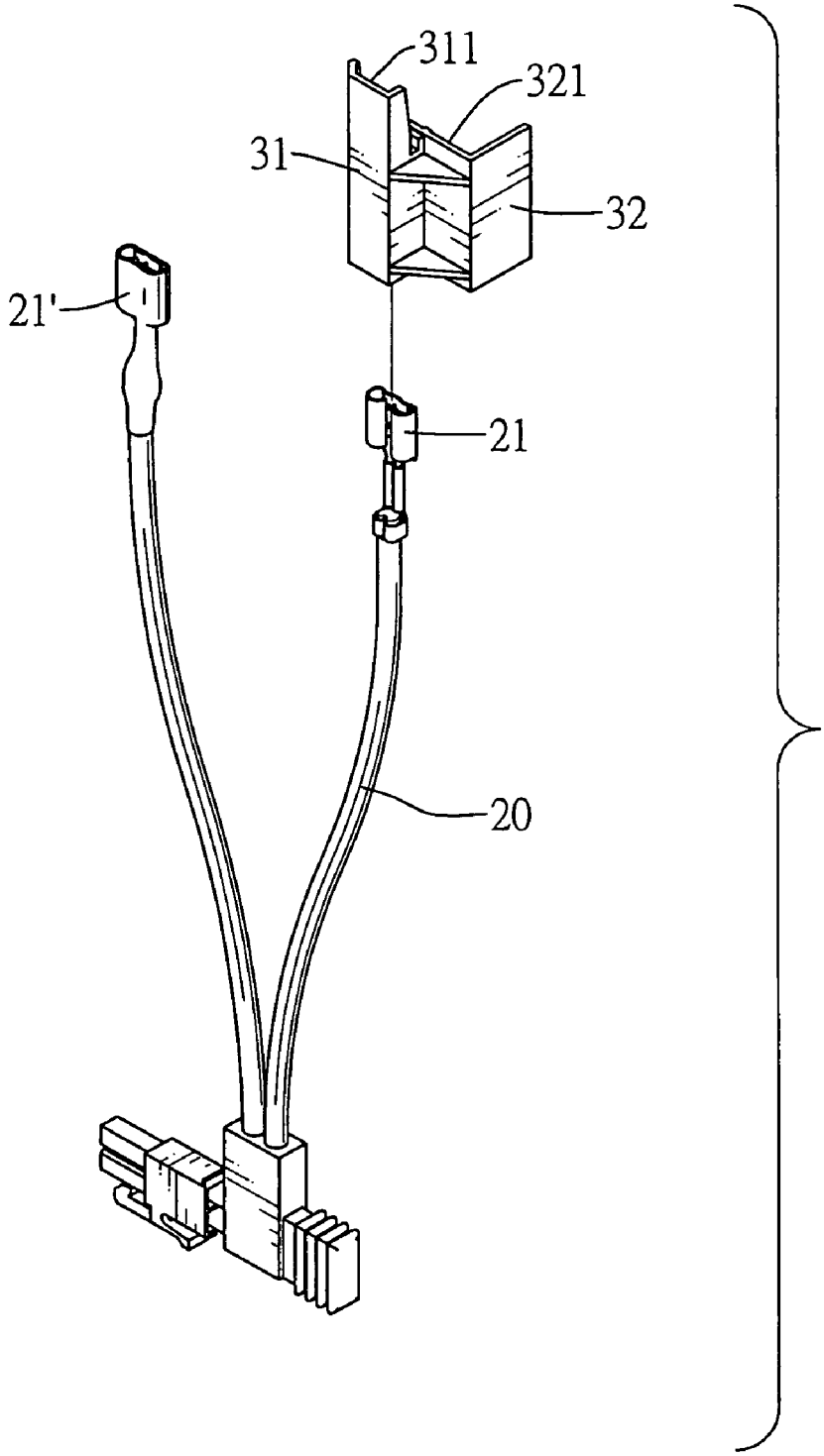
FIG. 2 is a partially exploded perspective view of a connector of the electrical connecting assembly in FIG. 1.

With reference to FIGS. 1 and 2, an electrical connecting assembly in accordance with the present invention has an electrical appliance (10) and a connector (20).

The electrical appliance (10) has at least one surface, an electrical circuit, a positive electrode plug (11) and a negative electrode plug (11 '). The surface has multiple edges and may be rectangular. The edges have a specific shape that may be curved or right angle edges. The electrical circuit is mounted in the electrical appliance (10). The positive electrode plug (11) is mounted on the surface, may be mounted near one of the edges of the surface and electrically connects to the electrical circuit. The negative electrode plug (11') is mounted on the surface separate from the positive electrode plug (11), may be mounted near the edge of the surface opposite to the edge near which the positive electrode plug is mounted and electrically connects to the electrical circuit.

The connector (20) selectively connects to the electrical appliance (10) and has a positive electrical wire, a negative electrical wire and an anti-error sheath (30).

The positive electrical wire has a positive electrode socket (21). The positive electrode socket (21) connects to the positive electrode plug (11).

The negative electrical wire has a negative electrode socket (21'). The negative electrode socket (21') connects to the negative electrode plug (11').

Figure 3:
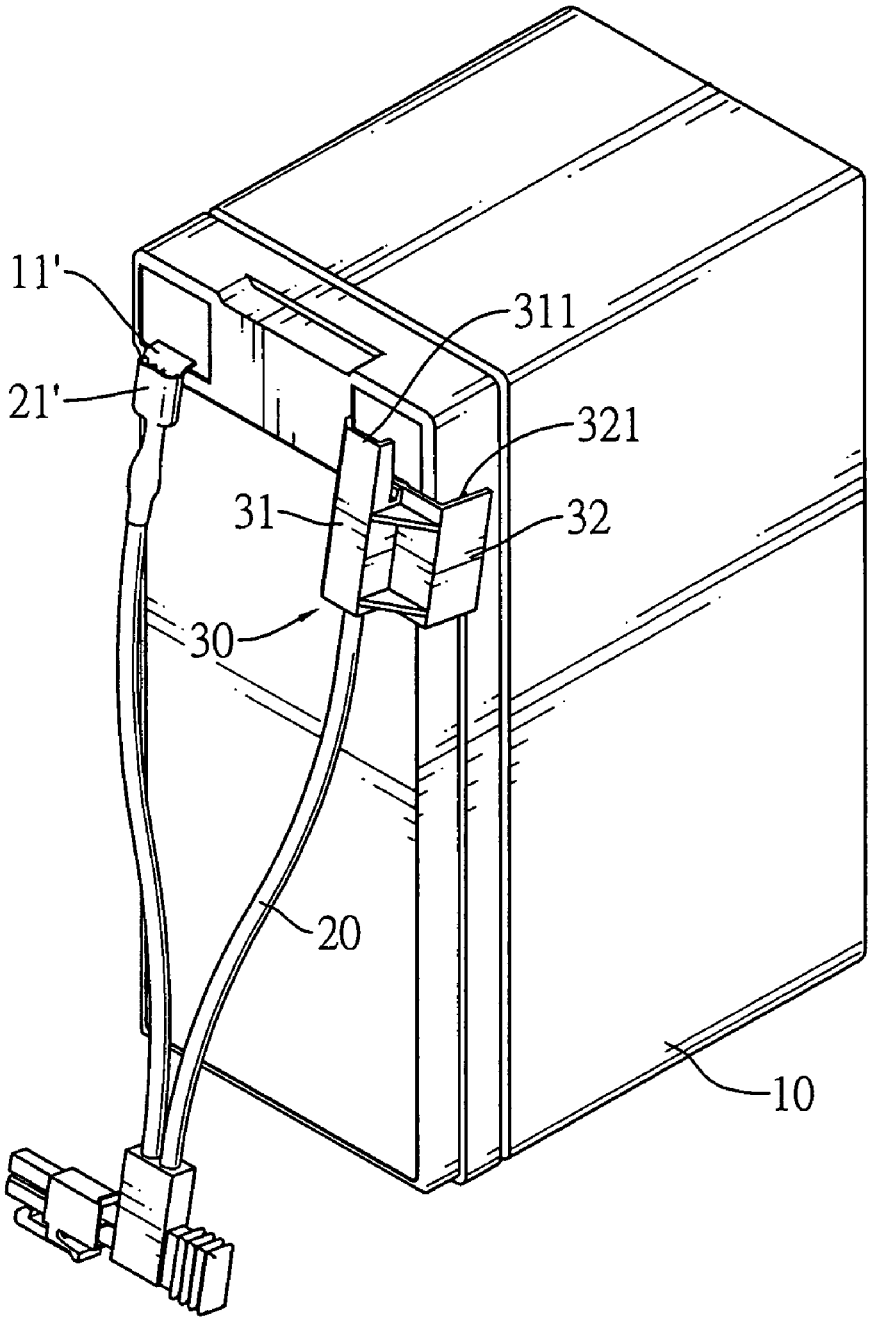
FIG. 3 is a perspective view of the electrical connecting assembly in FIG. 1.

With further reference to FIG. 3, the anti-error sheath (30) connects to one of the sockets (21, 21') and has a socket sheath (31) and a positioning indicator (32).

Figure 4:
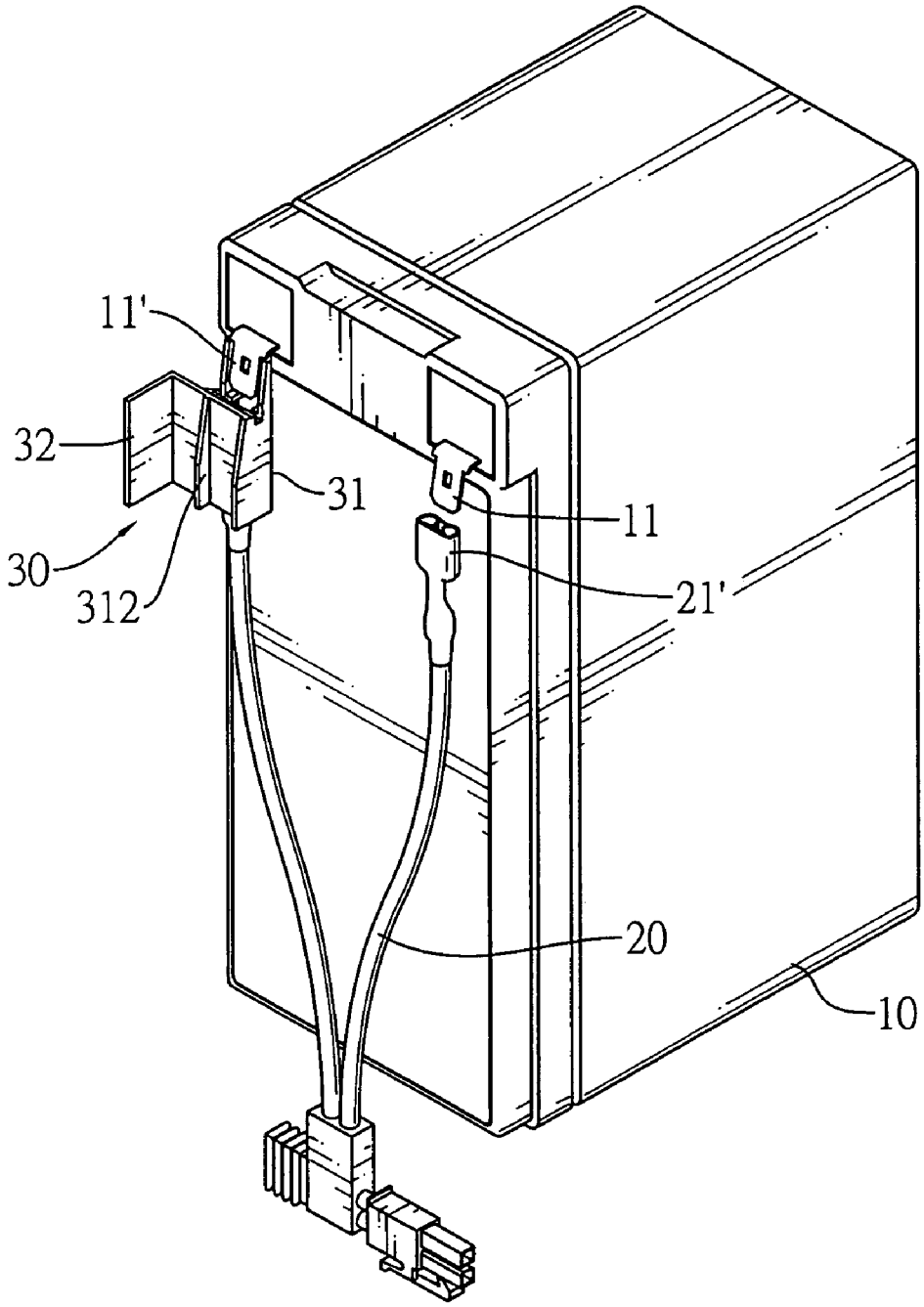
FIG. 4 is a perspective view of the electrical connecting assembly with a socket plugged onto an incorrect plug.
Figure 5:
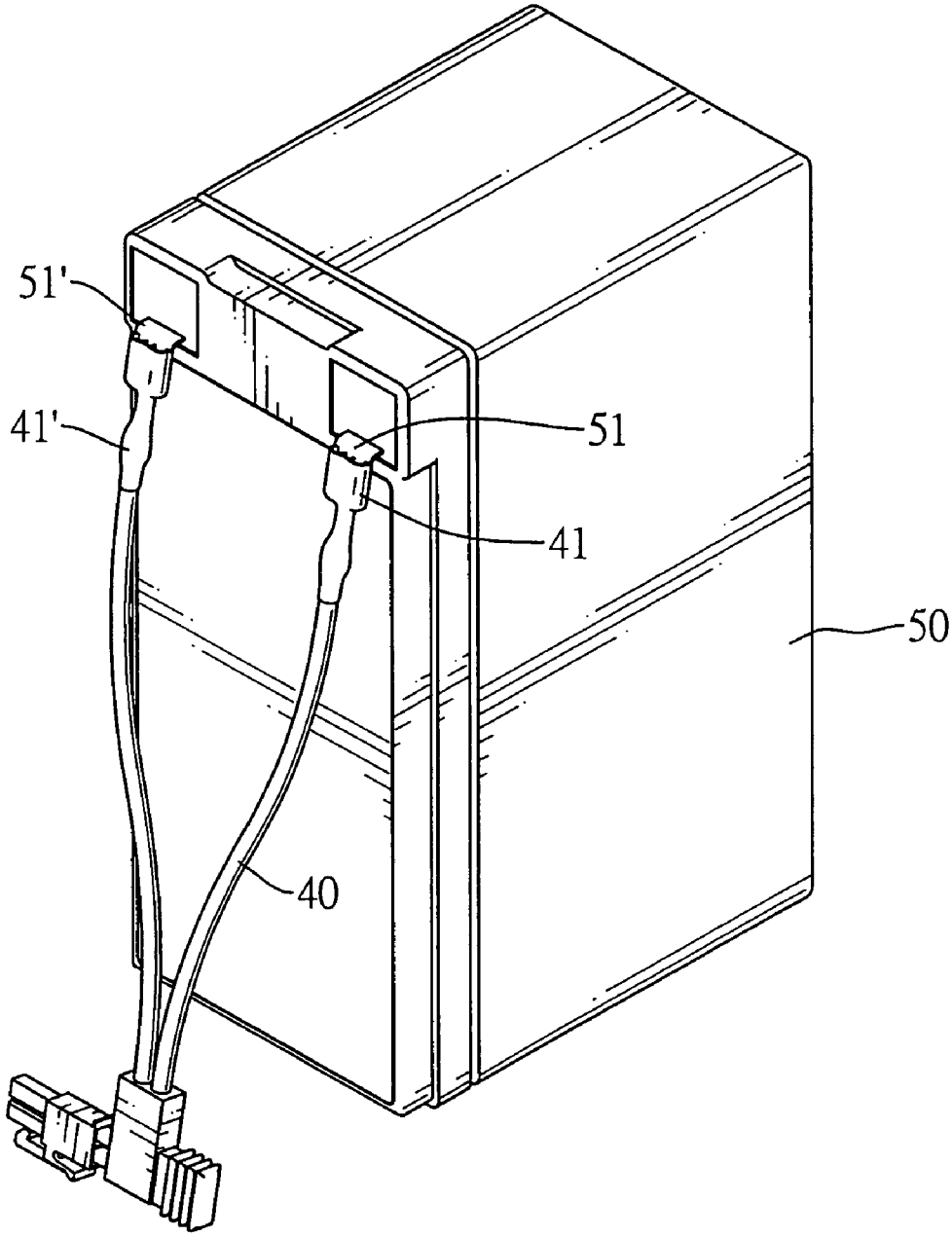
FIG.5 PRIOR ART
FIG. 5 is a perspective view of a conventional connecting assembly in accordance with the prior art.

The socket sheath (31) is tubular, is mounted on one of the sockets (21, 21') and has a rectangular cross section, a top surface, a bottom surface, a distal end, a mounting key (311) and at least one alignment rail. The mounting key (311) is formed on and protrudes longitudinally from the distal end flush with the top surface. When the socket (21, 21') inside the socket sheath (31) is plugged onto the correct plug (11, 11'), the mounting key (311) slides over the plug (11, 11'). With further reference to FIG. 4, attempting to plug the socket (21, 21') inside the socket sheath (31) onto the incorrect plug (11, 11') will cause the mounting key (311) to abut the plug (11, 11') and keep the socket (21, 21') from plugging onto the incorrect plug (11, 11'). The at least one alignment rail (312) is formed on and protrudes down from the bottom surface and abuts the surface of the electrical appliance (10) when the socket (21, 21') is plugged onto the correct plug (11, 11').

The positioning indicator (32) is L-shaped, is formed on and protrudes laterally out from the bottom surface of the socket sheath (31), is formed separately from and perpendicularly to the mounting key (311), indicates onto which plug (11, 11') the attached socket (21, 21') should be plugged and has a shape and a distal edge (321). The shape of the positioning indicator (32) corresponds to the shape of the edge of the surface of the appliance (10) so the socket sheath (31) and the socket (21, 21') mounted in the socket sheath (31) can only be positioned with the correct plug (11, 11') when the position indicator (32) is mounted flush against the edge of the surface of the appliance (10). The distal edge is flush with the distal end of the socket sheath (31).

When users attempt to plug the socket (21, 21') inside the socket sheath (31) onto the incorrect plug (11, 11') will cause the mounting key (311) to abut the plug (11, 11') and keep the socket (21, 21') from plugging onto the incorrect plug (11, 11'). Even users are color blindness or suffer from an amblyopia, they can plug the socket (21, 21') onto the correct plug (11, 11').

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An electrical connecting assembly comprising:

an electrical appliance having a surface having multiple edges with a shape;

a positive electrode plug being mounted on the surface; and a negative electrode plug being mounted on the surface separate from the positive electrode plug;

a connector selectively connecting to the electrical appliance and having a positive electrical wire having a positive electrode socket connecting to the positive electrode plug;

a negative electrical wire having a negative electrode socket connecting with the negative electrode plug; and a single anti-error sheath connecting to only one of the sockets and having a socket sheath being tubular, being mounted on one of the sockets and having a top surface;

a bottom surface;

a distal end; and a mounting key being formed on and protruding longitudinally from the distal end flush with the top surface; and a positioning indicator being L-shaped, formed on and protruding laterally out from the bottom surface of the socket sheath, formed separately from and perpendicularly to the mounting key, indicating onto which plug the attached socket should be plugged and having a shape corresponding to the shape of one of the edges of the surface of the electrical appliance; and a distal edge being flush with the distal end of the socket sheath.

2. The electrical connecting assembly as claimed in claim 1, wherein the positive electrode plug is mounted near one of the edges of the surface; and the negative electrode plug is mounted near the edge of the surface opposite to the edge near which the positive electrode plug is mounted.

3. The electrical connecting assembly as claimed in claim 2, wherein the edges of the surface are right angled.

4. The electrical connecting assembly as claimed in claim 1, wherein the socket sheath further has at least one alignment rail formed on and protruding down from the bottom surface and abutting the surface of the electrical appliance.

* * * * *